US007757646B2

(12) United States Patent
Kumagai et al.

(10) Patent No.: US 7,757,646 B2
(45) Date of Patent: Jul. 20, 2010

(54) CAMSHAFT SUPPORT STRUCTURE OF AN INTERNAL COMBUSTION ENGINE

(75) Inventors: Atsunori Kumagai, Sunto-gun (JP); Takanori Sasaki, Susono (JP); Tetsushi Suzuki, Mishima (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 479 days.

(21) Appl. No.: 11/886,878

(22) PCT Filed: Jan. 18, 2007

(86) PCT No.: PCT/IB2007/000124

§ 371 (c)(1),
(2), (4) Date: Sep. 21, 2007

(87) PCT Pub. No.: WO2007/083223

PCT Pub. Date: Jul. 26, 2007

(65) Prior Publication Data

US 2009/0013949 A1 Jan. 15, 2009

(30) Foreign Application Priority Data

Jan. 19, 2006 (JP) ..... 2006-010944

(51) Int. Cl.
*F01M 9/10* (2006.01)

(52) U.S. Cl. ..... 123/90.38; 123/90.16; 123/90.27; 123/90.39; 123/195 C; 123/193.5

(58) Field of Classification Search ..... 123/90.38, 123/90.39, 90.6, 90.16, 90.27, 90.31, 193.5, 123/193.3, 195 C, 198 E, 198 F; 74/559, 74/567, 569; 29/888.2
See application file for complete search history.

(56) References Cited

U.S. PATENT DOCUMENTS 4,762,099 A 8/1988 Fujii et al.

(Continued)

FOREIGN PATENT DOCUMENTS

EP 0635631 A 5/1994

(Continued)

OTHER PUBLICATIONS

European Office Action issued on Jun. 23, 2009 in EP 07 700 499.2.

*Primary Examiner*—Ching Chang
(74) *Attorney, Agent, or Firm*—Oliff & Berridge, PLC

(57) ABSTRACT

A camshaft support structure of an internal combustion engine (10) includes a camshaft (26, 30) that drives an intake valve (18) or an exhaust valve (20); a head cover (34) that houses the camshaft (26, 30); an upper bearing portion (42) which is provided on the head cover (34) and supports the camshaft (26, 30); a lower bearing portion (54) which is attached to the head cover (34) and makes a pair with the upper bearing portion (42) to retain the camshaft (26,30); a rocker arm (22, 24) that transmits driving force from the camshaft (26, 30) to the intake valve (18) or the exhaust valve (20); and a rocker arm support portion (56) that inhibits the rocker arm (22, 24) from falling out of position by being provided near and directly above the rocker arm (22, 24).

15 Claims, 9 Drawing Sheets

U.S. PATENT DOCUMENTS

| | | | | |
|---|---|---|---|---|
| 5,458,099 | A | 10/1995 | Koller et al. | |
| 6,550,432 | B2 * | 4/2003 | Takahashi et al. | 123/90.15 |
| 2002/0185094 | A1 | 12/2002 | Yoon | |

FOREIGN PATENT DOCUMENTS

| | | | |
|---|---|---|---|
| EP | 0 635 631 | A1 | 1/1995 |
| EP | 1239136 | A | 3/2002 |
| EP | 1 239 136 | A1 | 9/2002 |
| EP | 1457657 | A | 3/2004 |
| EP | 1 441 122 | A1 | 7/2004 |
| EP | 1 457 657 | A2 | 9/2004 |
| GB | 1201558 | | 5/1968 |
| GB | 1 201 558 | | 8/1970 |
| GB | 2193997 | A | 7/1987 |
| GB | 2 193 997 | A | 2/1988 |
| JP | A-60-187706 | | 9/1985 |
| JP | A-60-195320 | | 10/1985 |
| JP | U 63-83402 | | 6/1988 |
| JP | A-02-248606 | | 10/1990 |
| JP | U-02-147857 | | 12/1990 |
| JP | U-03-097505 | | 10/1991 |
| JP | A-5-280312 | | 3/1992 |
| JP | A 05-280312 | | 10/1993 |
| JP | U-06-22551 | | 3/1994 |
| JP | U-06-083912 | | 12/1994 |
| JP | A-07-166956 | | 6/1995 |
| JP | A-11-247710 | | 9/1999 |
| JP | A-2003-155904 | | 11/2001 |
| JP | A 2003-155904 | | 5/2003 |
| JP | A-2005-9451 | | 6/2003 |
| JP | A 2005-009451 | | 1/2005 |
| JP | A-2005-163703 | | 6/2005 |
| WO | WO 00/20730 | A | 10/1999 |
| WO | WO 00/20730 | | 4/2000 |
| WO | WO 2004/040115 | A1 | 5/2004 |

* cited by examiner

CAMSHAFT SUPPORT STRUCTURE OF AN INTERNAL COMBUSTION ENGINE

BACKGROUND OF THE INVENTION

1. Field of the Invention

The invention relates to a camshaft support structure of an internal combustion engine.

2. Description of the Related Art

Technology is known which drives intake valves and exhaust valves by transmitting motion of a camshaft to the valves via rocker arms. Technology is also known in which a bearing portion on an upper side of a camshaft is provided on a head cover.

The rocker arms are first retained in predetermined positions by being sandwiched between the camshaft and the intake valves or the exhaust valves. Therefore, before the camshaft is assembled above the rocker arms, the rocker arms are unstable and may fall out of position when the camshaft is assembled above them. In particular, when assembling the head cover to the cylinder head after a bearing portion for the camshaft is provided on the head cover and the camshaft is assembled to the head cover, it is difficult to assemble the head cover while checking the state of each rocker arm, and the rocker arms tend to fall out of position when the head cover is being assembled. Moreover, if the rocker arms do fall out of position, they must be returned to the correct positions and the head cover then reassembled, which is troublesome.

In an attempt to solve this problem, Japanese Patent Application Publication No. JP-A-2003-155904 describes technology which inhibits rocker arms from falling out of position by providing a part that temporarily retains them. However, providing a part that temporarily retains the rocker arms increases the flow resistance of blowby gas. As a result, the flow velocity of the blowby gas increases such that oil is carried away with it. In addition, providing that part increases the total number of parts which increases the number of assembly processes, thereby raising manufacturing costs.

SUMMARY OF THE INVENTION

This invention inhibits a rocker arm from falling out of position during assembly of a head cover to a cylinder head when a bearing portion of a camshaft is provided on the head cover.

A first aspect of the invention therefore relates to a camshaft support structure of an internal combustion engine, which includes a camshaft that drives one of an intake valve and an exhaust valve; a head cover that houses the camshaft; a first bearing portion which is provided on the head cover and supports the camshaft; a second bearing portion which is attached to the head cover and makes a pair with the first bearing portion to support the camshaft; a rocker arm that transmits driving force from the camshaft to one of the intake valve and the exhaust valve; and rocker arm supporting means for inhibiting the rocker arm from falling out of position by being provided near and directly above the rocker arm.

According to the first aspect, the rocker arm supporting means is provided which inhibits the rocker arm from falling out of position. Accordingly, the rocker arm is inhibited from falling out of position when the head cover is assembled onto the rocker arm. As a result, work efficiency during assembly of the head cover can be greatly improved.

According to a second aspect of the invention, in the first aspect, the rocker arm supporting means is provided directly above the center of rotation of the rocker arm when the rocker arm is being driven.

According to the second aspect, the center of rotation of the rocker arms when they are driven moves only slightly so by providing the rocker arm supporting means directly above the center of rotation, the rocker arms and the rocker arm supporting means can be as close as possible to each other. As a result, the rocker arm can be suppressed from falling out of position during assembly.

According to a third aspect of the invention, in the first or second aspect, the rocker arm supporting means is provided on the head cover.

According to the third aspect, the rocker arm supporting means is provided on the head cover so the rocker arm supporting means can be integrally formed with the head cover, thereby reducing manufacturing costs.

According to a fourth aspect of the invention, in the third aspect, an oil injection hole through which oil is injected near the rocker arm is further provided in the rocker arm supporting means.

According to the fourth aspect, an oil injection hole is provided in the rocker arm supporting means so oil can be directly supplied near the rocker arm from a position near the rocker arm. This obviates the need to provide an oil delivery pipe above the rocker arm, and thus enables lubrication to be performed effectively with a simple structure.

According to a fifth aspect of the invention, in the first or second aspect, the rocker arm supporting means is provided on the second bearing portion.

According to the fifth aspect, the rocker arm supporting means is provided on the second bearing portion so the rocker arm supporting means can be integrally formed with the second bearing portion, thereby reducing manufacturing costs.

According to a sixth aspect of the invention, in the fifth aspect, the second bearing portion and the camshaft are separated by a predetermined distance.

According to the sixth aspect, valve spring reaction force transmitted via the rocker arm is transmitted to the first bearing portion so the second bearing portion can be separated from the camshaft. As a result, friction is reduced and the second bearing portion can be simplified which reduces manufacturing costs. Also, separating the second bearing portion from the camshaft enables the length of the rocker arm supporting means to be shortened which improves the flow of both blowby gas and oil on the inside of the head cover. Furthermore, making the rocker arm support member shorter also improves assemblability.

According to a seventh aspect of the invention, in the first or second aspect, a plurality of the second bearing portions are provided, connecting means for connecting the second bearing portions that are adjacent is also provided, and the rocker arm supporting means is provided on the connecting means.

According to the seventh aspect, adjacent second bearing portions are connected which increases the rigidity of the second bearing portions.

According to an eighth aspect of the invention, in the fifth aspect, an outer frame portion that connects the circumferences of the plurality of second bearing portions, and a cylinder head to which the intake valve, the exhaust valve, and the rocker arm are assembled are also provided, and the outer frame portion is sandwiched between the head cover and the cylinder head.

According to the eighth aspect, an outer frame portion that connects the circumferences of the second bearing portions is provided and this outer frame portion is sandwiched between the head cover and the cylinder head. As a result, the rigidity of second bearing portion is increased.

BRIEF DESCRIPTION OF THE DRAWINGS

The foregoing and further objects, features and advantages of the invention will become apparent from the following description of preferred embodiments with reference to the accompanying drawings, wherein like numerals are used to represent like elements and wherein.

DETAILED DESCRIPTION OF THE PREFERRED EMBODIMENTS

Figure 1:
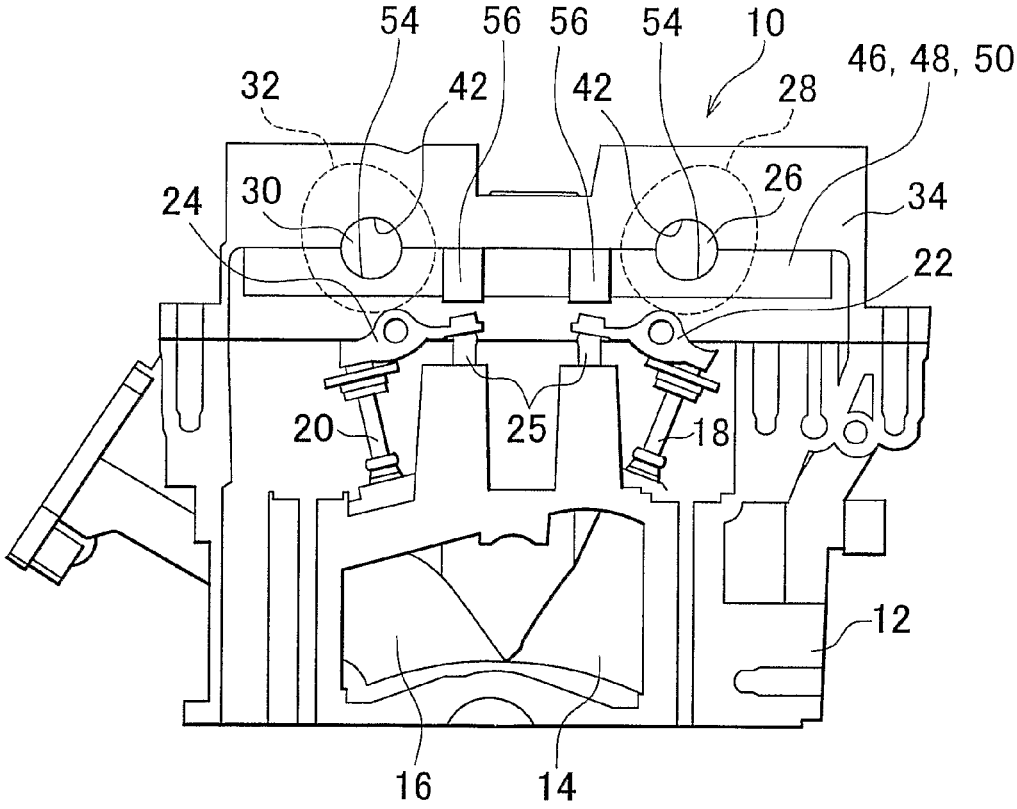
FIG. 1 is a sectional view of a camshaft support structure according to a first example embodiment of the invention.

Hereinafter, example embodiments of the invention will be described in detail with reference to the accompanying drawings. In the following description and the drawings, like elements will be denoted by like reference numerals and redundant descriptions will be omitted. It should be noted that the invention is not to be limited to the following example embodiments.

FIG. 1 is a sectional view of a camshaft support structure according to a first example embodiment of the invention. More specifically, FIG. 1 is a sectional view of the camshaft support structure of this example embodiment cut along a plane that passes through the center of a cylinder. The internal combustion engine 10 in this example embodiment is an in-line four cylinder engine. Each cylinder in the internal combustion engine 10 has two intake valves and two exhaust valves.

As shown in FIG. 1, the internal combustion engine 10 includes a cylinder head 12. The cylinder head 12 is provided with an intake port 14 and an exhaust port 16 in each cylinder and incorporates intake valves 18 which open and close the intake port 14, and exhaust valves 20 which open and close the exhaust port 16. The upper end of each intake valve 18 contacts one end of a rocker arm 22 and the upper end of each exhaust valve 20 contacts one end of a rocker arm 24.

Urging force from spring valves, not shown, acts on the intake valves 18 and the exhaust valves 20, causing them to urge one end of each rocker arm 22 and 24 upward. The other end of each rocker arm 22 and 24 is supported by a lash adjuster 25.

An intake camshaft 26 to which intake cams 28 that abut against the rocker arm 22 are fixed is arranged above the rocker arm 22. Similarly, an exhaust camshaft 30 to which exhaust cams 32 that abut against the rocker arm 24 are fixed is arranged above the rocker arm 24.

Figure 2:
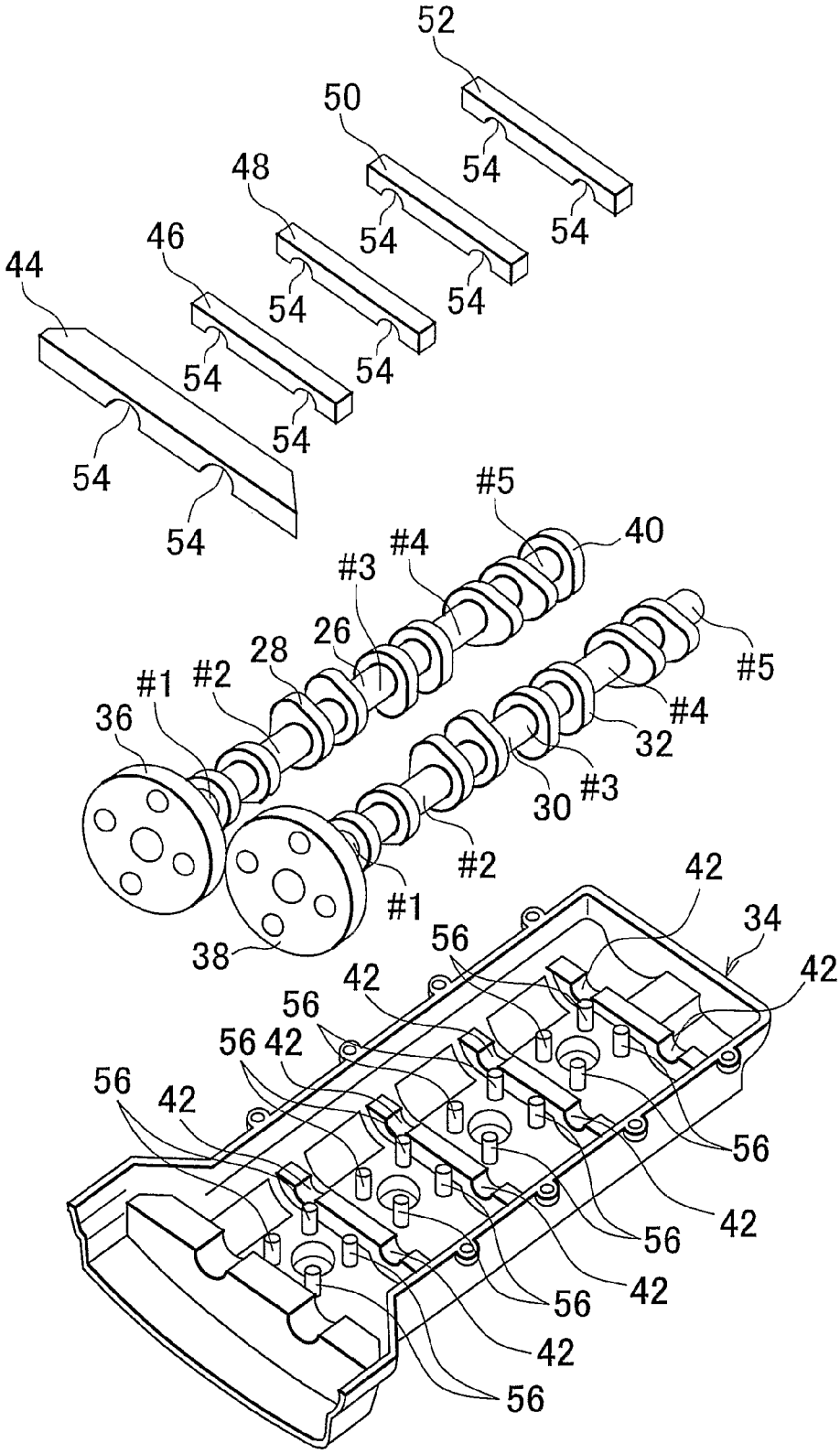
FIG. 2 is a perspective view of a head cover shown in FIG. 1 as viewed from the rocker arm side.

A head cover 34 with an integrated upper cam carrier (hereinafter simply referred to as "head cover 34") is fastened by bolts, not shown, to the upper portion of the cylinder head 12. FIG. 2 is a perspective view of the head cover 34 shown in FIG. 1 as viewed from the side with the rocker arms 22 and 24. More specifically, FIG. 2 is an exploded perspective view of the head cover 34, the intake camshaft 26, the exhaust camshaft 30, and lower bearing members 44, 46, 48, 50, and 52, which will be described later. As shown in FIG. 2, timing sprockets 36 and 38 around which a chain that transmits driving force from a crankshaft is wound are fixed to one end of the intake camshaft 26 and the exhaust camshaft 30, respectively. Also, a pump driving cam 40 for driving a fuel pump, not shown, is fixed to the other end of the intake camshaft 26.

As shown in FIG. 2, upper bearing portions 42 which support the intake camshaft 26 and the exhaust camshaft 30 are integrally formed on the head cover 34. More specifically, the upper bearing portions 42 are provided in sets of two in a total of five places, i.e., three places in between the cylinders of the internal combustion engine 10 and two places on the outside of the cylinders at the ends (i.e., one place at each end). The upper bearing portions 42 are formed in semicircular concave shapes so as to be able to support journal portions of the intake camshaft 26 and the exhaust camshaft 30. As shown in the FIG. 2, in order to distinguish between the journal portions of the intake camshaft 26 and the exhaust camshaft 30, each journal portion is denoted by a reference numeral #1 to #5 in order from the side closest to the timing sprockets 36 and 38.

Corresponding lower bearing members 44, 46, 48, 50, and 52 are matched with the upper bearing portions 42. Two lower bearing portions 54 are formed on each of the lower bearing members 44, 46, 48, 50, and 52. The lower bearing portions 54 are also formed in semicircular concave shapes having the same diameter as the upper bearing portions 42 so as to be able to support the journal portions #1 to #5 of the intake camshaft 26 and the exhaust camshaft 30. The lower bearing members 44, 46, 48, 50, and 52 are firmly fixed to the head cover 34 by bolts, not shown, with the intake camshaft 26 and the exhaust camshaft 30 mounted in the upper bearing portions 42.

The lower bearing members 44, 46, 48, 50, and 52 are made of material which is lighter than the material of the head cover 34. More specifically, the head cover 34 is made of aluminum while the lower bearing members 44, 46, 48, 50, and 52 are made of magnesium or magnesium alloy, for example. The lower bearing members 44, 46, 48, 50, and 52 are not limited to magnesium or magnesium alloy as long as they are made of material that is lighter in weight than the material of which the head cover 34 is made, e.g., they may also be made of resin composite.

As shown in FIG. 2, rocker arm support portions 56 are provided next to the side of each upper bearing portion 42 of the head cover 34. These rocker arm support portions 56 are formed integrally with the head cover 34.

Because the upper bearing portions 42 are provided on the head cover 34 in positions corresponding to areas between the cylinders and on the outsides of each of the two end cylinders, the rocker arms 22 and 24 of adjacent cylinders end up being arranged next to the upper bearing portions 42 once the head cover 34 has been assembled onto the cylinder head 12. As shown in FIG. 1, the rocker arm support portions 56 are formed in positions that end up being above the rocker arms 22 and 24 once the head cover 34 has been assembled onto the cylinder head 12.

More specifically, once the head cover 34 has been assembled onto the cylinder head 12, the rocker arm support portions 56 are arranged directly above the fulcrum (i.e., the center of rotation) of the rocker arms 22 and 24 when the rocker arms 22 and 24 are driven. That is, the rocker arm support portions 56 are positioned directly above the lash adjusters 25. Also, once the head cover 34 has been assembled onto the cylinder head 12, there is a predetermined gap between the upper surfaces of the rocker arms 22 and 24 and the tips of the rocker arm support portions 56.

After the intake camshaft 26, the exhaust camshaft 30, and the lower bearing members 44, 46, 48, 50, and 52 have been assembled onto the head cover 34, the head cover 34 is then attached to the cylinder head 12. According to the structure described above, when the head cover 34 to which the intake camshaft 26 and the exhaust camshaft 30 have been assembled is then assembled onto the cylinder head 12, the tips of the rocker arm support portions 56 are close to the upper portions of the rocker arms 22 and 24. Therefore, if the rocker arms 22 and 24 start to slide out of their predetermined positions above the intake valves 18 and the exhaust valves 20 during the assembly process, the upper surfaces of the rocker arms 22 and 24 will abut against the rocker arm support portions 56, thus inhibiting the rocker arms 22 and 24 from falling out of position. Hence, the rocker arms 22 and 24 are able to be prevented from falling out of position during assembly.

If the rocker arms 22 and 24 fall out of position when the head cover 34 is being assembled onto the cylinder head 12, they must be returned to their predetermined positions above the intake valves 18 and exhaust valves 20, and the head cover 34 must then be reassembled onto the cylinder head 12. This example embodiment makes it possible to prevent the rocker arms 22 and 24 from falling out of position, which eliminates the troublesome work of reassembly and thus increases work efficiency during assembly. Furthermore, providing the rocker arm support portions 56 makes it possible to prevent oil from being flung away by the rotation of the intake camshaft 26 and the exhaust camshaft 30.

Once the head cover 34 has been assembled onto the cylinder head 12, there is a predetermined gap between the upper surfaces of the rocker arm 22 and 24 and the rocker arm support portions 56. As a result, after assembly there is no contact between the rocker arm support portions 56 and the upper surfaces of the rocker arms 22 and 24 when the rocker arms 22 and 24 move. Also after assembly, even if the rocker arms 22 and 24 start to fall out of position due to, for example, a failure when they are being driven, movement of the rocker arms 22 and 24 is restricted by the rocker arm support portions 56, preventing them from doing so.

Figure 3:
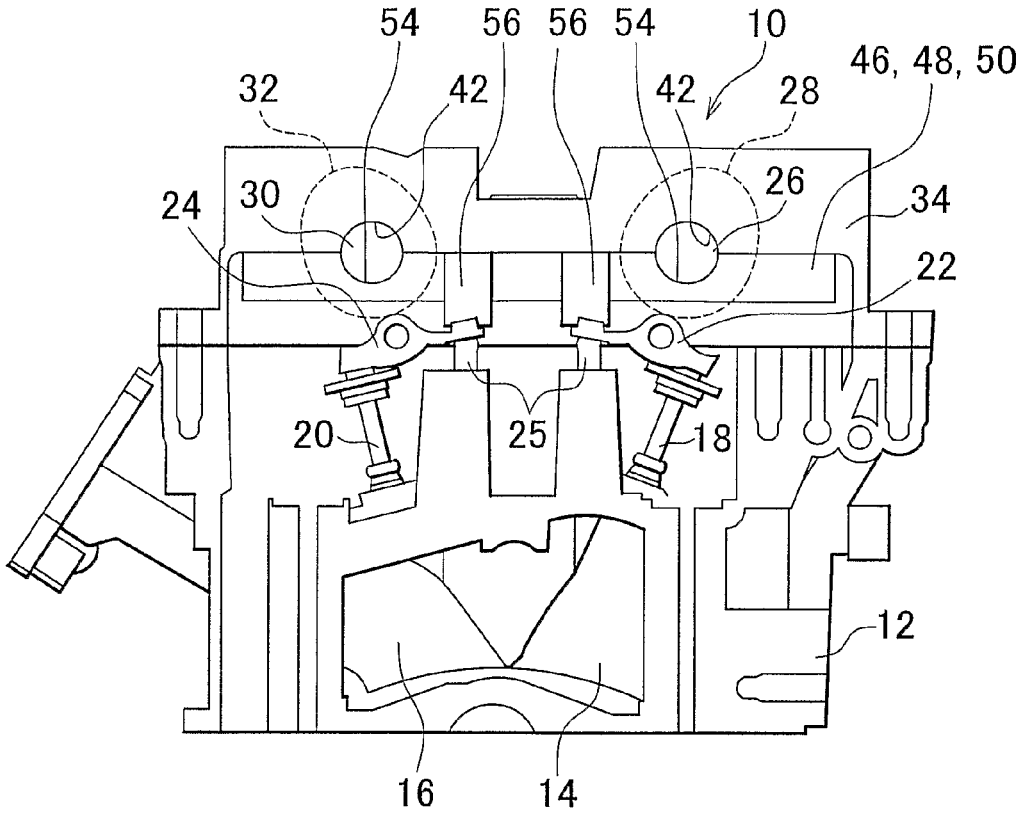
FIG. 3 is a sectional view of an example in which rocker arm support portions are provided near the side surface of a rocker arm.

In the above example, the rocker arm support portions 56 are arranged above the fulcrums of the rocker arms 22 and 24. Alternatively, however, the rocker arm support portions 56 may also be positioned next to the rocker arms 22 and 24. FIG. 3 is a sectional view of an example in which the rocker arm support portions 56 are positioned near the side surfaces of the rocker arms 22 and 24. In this sectional view, the camshaft support structure is shown cut along a plane that runs through the center of a cylinder. In this case as well, even if the rocker arms 22 and 24 start to fall out of position when the head cover 34 is assembled onto the cylinder head 12, the side surfaces of the rocker arms 22 and 24 abut against the rocker arm support portions 56 and are supported by them, thus inhibiting the rocker arms 22 and 24 from falling out of position.

Figure 4:
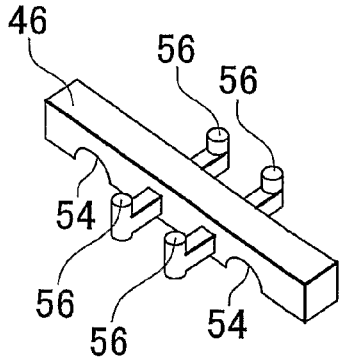
FIG. 4 is a frame format view of an example in which the rocker arm support portions are provided on a lower bearing member.

Also, in the foregoing description, the head cover 34 and the rocker arm support portions 56 are separate but the rocker arm support portions 56 may also be formed attached to the head cover 34. Moreover, as shown in FIG. 4, the rocker arm support portions 56 may also be provided on the lower bearing members 44, 46, 48, 50, and 52.

Figure 5:
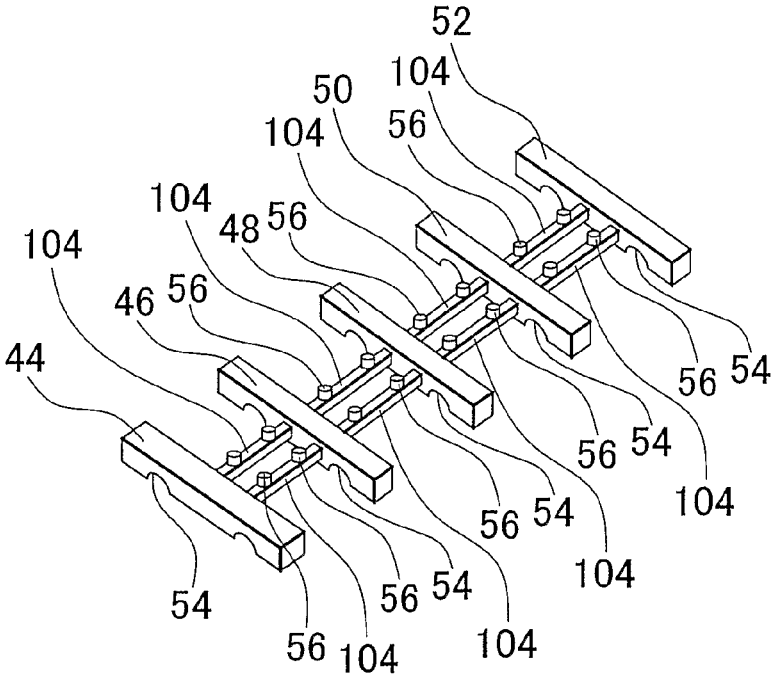
FIG. 5 is a frame format view of an example in which adjacent lower bearing members are connected by connecting portions and the rocker arm support portions are provided on the connecting portions.

FIG. 5 is a frame format view of an example in which adjacent lower bearing members 44, 46, 48, 50, and 52 are connected by connecting portions 104, and the rocker arm support portions 56 are provided on these connecting portions 104. This structure increases the rigidity of the lower bearing members 44, 46, 48, 50, and 52 by the connecting portions 104. Also, the lower bearing members 44, 46, 48, 50, and 52 are integrated together so assembly to the head cover 34 only needs to be done once which increases workability during assembly.

As described above, according to the first example embodiment the rocker arm support portions 56 are provided on the head cover 34 or the lower bearing members 44, 46, 48, 50, and 52, or the like which prevents the rocker arms 22 and 24 from falling out of position when the head cover 34 is assembled onto the cylinder head 12. Accordingly, work efficiency when assembling the head cover 34 onto the cylinder head 12 can be improved.

Figure 6:
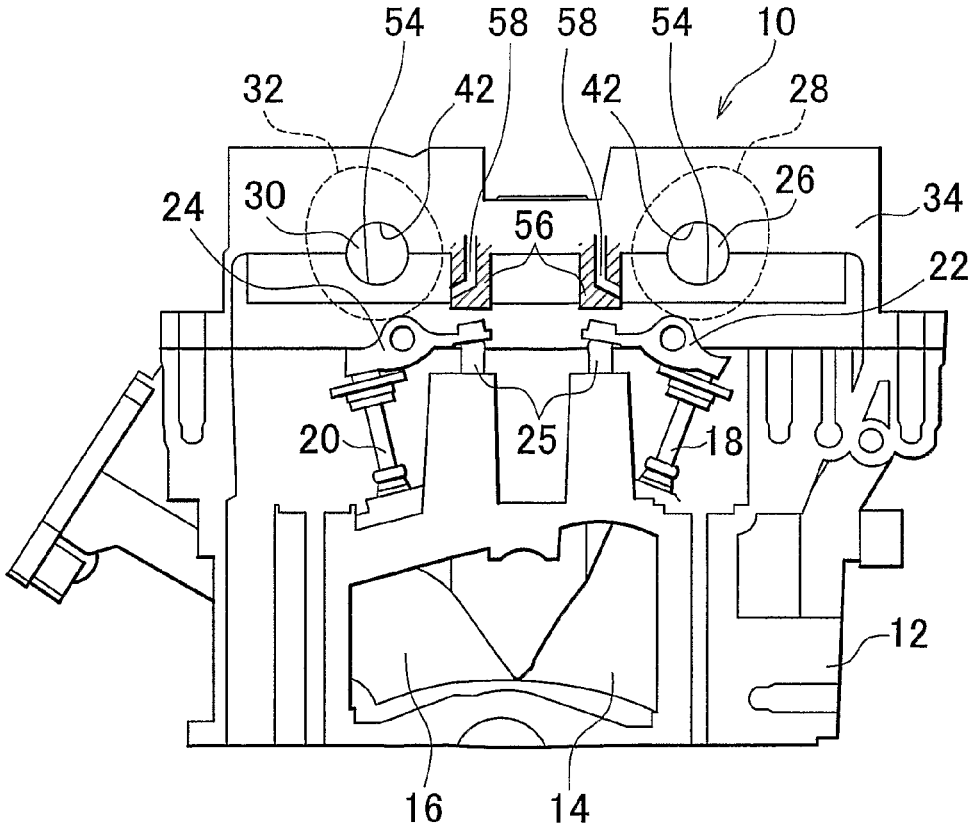
FIG. 6 is a sectional view of a camshaft support structure according to a second example embodiment.

Next, a second example embodiment of the invention will be described. FIG. 6 is a sectional view of a camshaft support structure according to the second example embodiment. This drawing shows the camshaft support structure of the second example embodiment cut along a plane that runs through the center of a cylinder. In the first example embodiment, the rocker arm support portions 56 are formed in positions near the rocker arms 22 and 24. In the second example embodiment, oil injection holes 58 are provided in the rocker arm support portions 56 so that oil can be supplied near the rocker arms 22 and 24 from the rocker arm support portions 56.

As shown in FIG. 6, the oil injection holes 58 are provided in the rocker arm support portions 56. The outlets of these oil injection holes 58 are aimed toward the portions where the rocker arms 22 and 24 abut against the intake cams 28 and the exhaust cams 32. Oil is supplied from an oil pump to these oil injection holes 58.

According to this structure, when an oil pump is driven to deliver oil to the oil injection holes 58, oil is injected toward the portions where the rocker arms 22 and 24 abut against the intake cams 28 and the exhaust cams 32. Accordingly, oil can be supplied toward the portions where the rocker arms 22 and 24 abut against the intake cams 28 and exhaust cams 32 from locations closest to those abutting portions, which obviates the need to provide an oil delivery pipe above the rocker arms 22 and 24, thereby simplifying the structure of the head cover 34.

As described above, according to the second example embodiment, oil injection holes 58 are provided in the rocker arm support portions 56, which enables oil to be directly supplied from the rocker arm support portions 56 toward the portions where the rocker arms 22 and 24 abut against the intake cams 28 and the exhaust cams 32. Accordingly, the area near the rocker arms 22 and 24 can be lubricated by means of a simple structure without having to provide an oil delivery pipe.

Next, a third example embodiment of the invention will be described. This third example embodiment provides the rocker arm support portions 56 integrally with the lower bearing members and further simplifies the structure of the lower bearing members.

Figure 7:
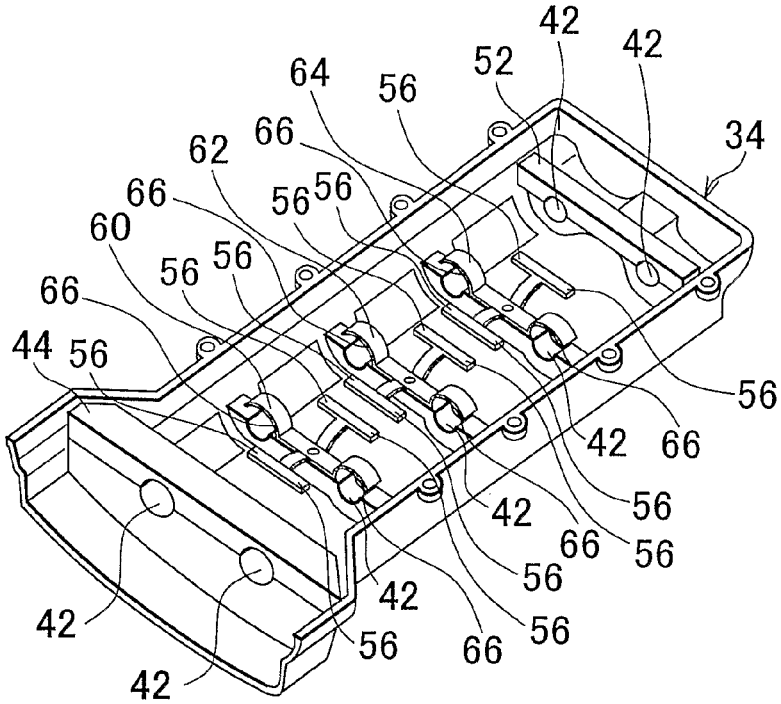
FIG. 7 is a perspective view of a head cover according to the second example embodiment as viewed from the rocker arm side.

FIG. 7 is a perspective view of the head cover 34 viewed from the side with the rocker arms 22 and 24, similar to FIG. 2, and shows the lower bearing members 44 and 52 and the lower bearing members 60, 62, and 64 assembled onto the head cover 34. In FIG. 7, the lower bearing members 44 and 52 which support the #1 and #5 journal portions have the same structure as they do in the first example embodiment. The lower bearing members 60, 62, and 64 which correspond to the #2 to #4 journal portions, on the other hand, are different from the lower bearing members 46, 48, and 50 in the first example embodiment. The intake camshaft 26 and the exhaust camshaft 30 are not shown in FIG. 7.

Upper bearing portions 42 are provided on the head cover 34, similar to the first example embodiment. The lower bearing members 60, 62, and 64 all have the same shape and are fixed to the head cover 34 with the intake camshaft 26 and the exhaust camshaft 30 mounted to the upper bearing portions 42. The camshaft support portions 56 are provided on each of the lower bearing members 60, 62, and 64. The lower bearing members 60, 62, and 64 are each installed above the upper bearing portions 42 corresponding to the #2 to #4 journal portions, respectively. Also, just as in the first example embodiment, the rocker arm support portions 56 provided on the lower bearing members 60, 62, and 64 end up being positioned above the rocker arms 22 and 24 once the head cover 34 has been mounted onto the cylinder head 12.

Figure 8:
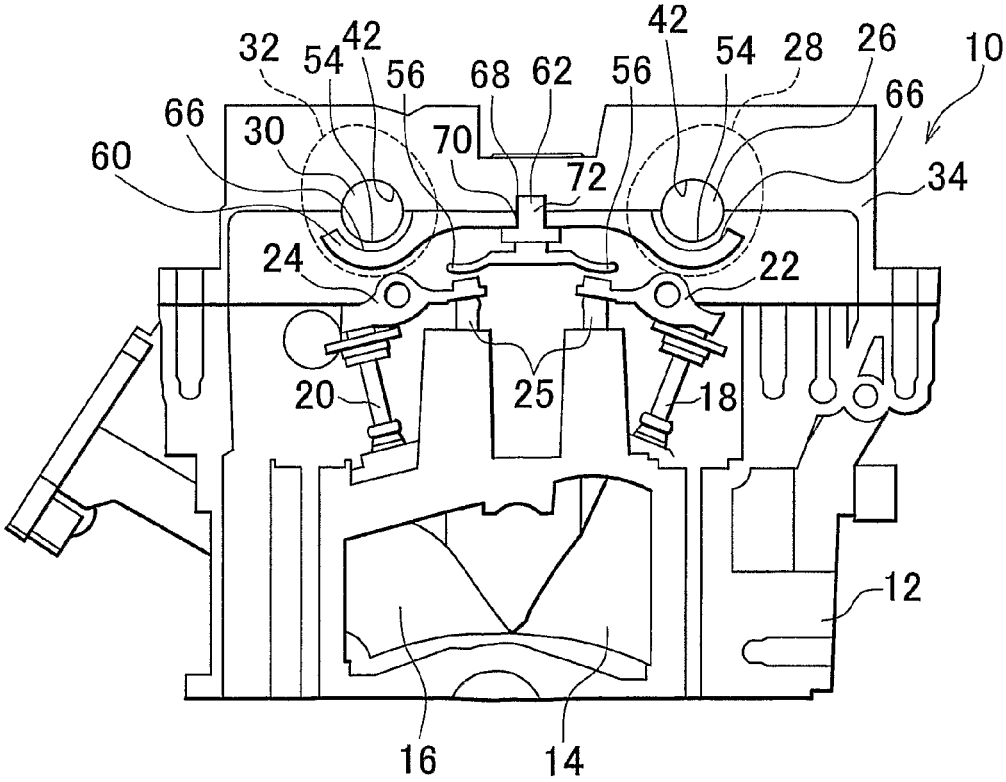
FIG. 8 is a sectional view of a camshaft support structure according to a third example embodiment.

FIG. 8 is a sectional view of the camshaft support structure according to the third example embodiment shown cut along a plane that runs through the center of a cylinder. FIG. 8 mainly shows the positional relationship between the lower bearing member 60 and the rocker arms 22 and 24.

As shown in FIG. 8, the rocker arm support portions 56 are positioned directly above the fulcrum of the rocker arms 22 and 24 when the rocker arms 22 and 24 are driven once the head cover 34 has been assembled onto the cylinder head 12. That is, the rocker arm support portions 56 are arranged in positions directly above the lash adjusters 25. Also, there is a predetermined gap between the upper surfaces of the rocker arms 22 and 24 and the rocker arm support portions 56.

According to this structure, the rocker arm support structures 56 are close to the upper portions of the rocker arms 22 and 24 when the head cover 34 to which the intake camshaft 26 and the exhaust camshaft 30 have been assembled is assembled onto the cylinder head 12. Accordingly, if the rocker arms 22 and 24 start to slide out of their predetermined positions above the intake valves 18 and the exhaust valves 20 during the assembly process, the upper surfaces of the rocker arms 22 and 24 will abut against the rocker arm support portions 56, which inhibits the rocker arms 22 and 24 from falling out of position. Hence, the rocker arms 22 and 24 are able to be prevented from falling out of position.

This eliminates the trouble of having to reassemble the head cover 34 onto the cylinder head 12 which is necessary if the rocker arms 22 and 24 fall out of position, and thus improves work efficiency during assembly.

As shown in FIG. 8, lower bearing portions 66 are provided on each lower bearing member 60, 62, and 64. These lower bearing portions 66 are formed in semicircular concave shapes having a larger diameter than the upper bearing portions 42 in order to ensure sufficient space between them and the intake camshaft 26 and the exhaust camshaft 30 once the intake camshaft 26 and the exhaust camshaft 30 have been assembled. In other words, the lower bearing portions 66 are formed so that there is a predetermined gap (space) between them and the intake camshaft 26 and the exhaust camshaft 30 once the intake camshaft 26 and the exhaust camshaft 30 have been assembled.

Therefore, the structure of the lower bearing members 60, 62, and 64 can be simplified as will be described below, thus reducing manufacturing costs. Also, the lower bearing portions 66 are separated from the intake camshaft 26 and the exhaust camshaft 30 which reduces friction. In addition, separating the lower bearing portions 66 from the intake camshaft 26 and the exhaust camshaft 30 also can be shifted the position of the lower bearing portions 66 downward compared with the case that the lower bearing portions 66 directly support the intake camshaft 26 and the exhaust camshaft 30 so the rocker arm support portions 56 can be shortened, which improves the flow of both blowby gas and oil on the inside of the head cover 34. Furthermore, shorter rocker arm support portions 56 also improve assemblability.

As shown in FIG. 8, a bolt fastening hole 68 is formed between two upper bearing portions 42 that support the #2 journal portion. Similarly, a bolt fastening hole 68 is formed between the two upper bearing portions 42 that support the #3 and #4 journal portions. Also, a through-hole 70 is formed between the two lower bearing portions 66 of each lower bearing member 60, 62, and 64. The lower bearing members 60, 62, and 64 are fixed to the head cover 34 by fastening bolts 72 that are inserted through the through-holes 70 and screwed into (i.e., secured to) the bolt fastening holes 68 while the intake camshaft 26 and the exhaust camshaft 30 are mounted to the upper bearing portions 42.

The intake valves 18 and the exhaust valves 20 are urged toward closed positions by valve springs. Therefore, when the noses of the intake cams 28 and the exhaust cams 32 press against the rocker arms 22 and 24, the rocker arms 22 and 24 pivot about their fulcrums which are the points at which they contact the lash adjusters 25 such that the intake valves 18 and the exhaust valves 20 are lifted open. At this time, reaction force from the valve springs is transmitted to the journal portions of the intake camshaft 26 and the exhaust camshaft 30. Accordingly, reaction force in the upward direction in FIG. 8 is input to the upper bearing portions 42 of the head cover 34 each time the noses of the intake cams 28 and the exhaust cams 32 press against the rocker arms 22 and 24.

Also, a load from the chain tension in the downward direction in FIG. 8 is exerted on the intake camshaft 26 and the exhaust camshaft 30, which are rotatably driven, via the timing sprockets 36 and 38. Therefore, in the support structure according to this example embodiment, the #1 lower bearing portion 44 that is arranged at the portion closest to the stress point of the chain tension is made highly rigid. As a result, the bending moment applied to the intake camshaft 26 and the exhaust camshaft 30 from this chain tension can be effectively suppressed.

Moreover, when a fuel pump which is driven by the camshaft 26 is mounted to the cylinder head portion, as it is in the internal combustion engine 10 of this example embodiment, a load in the downward direction in FIG. 8, more specifically, the load due to driving the fuel pump, is also applied to the #5 journal portion of the intake camshaft 26. With the support structure of this example embodiment, the lower bearing member 52 which corresponds to the #5 journal portion arranged in a position closest to the stress point of that load is made highly rigid. Therefore, the bending moment that is applied to the intake camshaft 26 from that load is able to be efficiently suppressed.

On the other hand, only the valve spring reaction force acts on the lower bearing members 60, 62, and 64 corresponding to the #2 to #4 journals. No force in the downward direction in FIG. 8 is applied to those lower bearing members 60, 62, and 64 so they do not need to be as rigid as the lower bearing members 44 and 52. That is, the lower bearing members 60, 62, and 64 need only be rigid enough to support the intake camshaft 26 and the exhaust camshaft 30 so that they do not fall out of position when assembling the head cover 34 to the cylinder head 12.

For the reasons described above, the structure of this example embodiment enables the structure of the lower bearing members 60, 62, and 64 to be simplified by taking into account the function that is actually required of the lower bearing members 60, 62, and 64 which correspond to the #2 to #4 journal portions. Also, the cylinder head portion can be made lighter by making the lower bearing members 60, 62, and 64 out of a lighter material than the material of which the head cover 34 is made.

When a structure is employed in which the camshaft mounted to the cylinder head or the like is fixed from above with cam caps, the cam caps must receive the valve spring reaction force. Therefore, bolt fastening portions are provided on both sides of the cam caps and the cam caps are rigidly connected to the cylinder head or the like using two fastening bolts per cam cap.

In contrast, with the support structure according to this example embodiment, the reaction force of the valve springs is received at the portion where the head cover 34 joins the cylinder head 12 so the lower bearing members 60, 62, and 64 do not need to be made extremely rigid, as described above. Accordingly, the fastening force when fixing the lower bearing members 60, 62, and 64 to the head cover 34 can be reduced. More specifically, as with the support structure of this example embodiment, the number of fastening bolts can be reduced to one, which reduces the number of parts.

Also, the lower bearing members 60, 62, and 64 are formed so that there are predetermined gaps between both end portions of the lower bearing members 60, 62, and 64, and the head cover 34 when the lower bearing members 60, 62, and 64 have been fixed to the head cover 34. More specifically, these gaps are wide enough so that if the lower bearing members 44 and 52 were removed, the intake camshaft 26 and the exhaust camshaft 30 could be removed while the lower bearing members 60, 62, and 64 were still assembled. This structure improves workability during maintenance.

In the third example embodiment as well, the rocker arm support portions 56 may also be positioned next to the rocker arms 22 and 24. In this case as well, if the rocker arms 22 and 24 start to fall out of position, the side surfaces of the rocker arms 22 and 24 will abut against the rocker arm support portions 56, inhibiting them from doing so.

As described above, according to the third example embodiment, the rocker arm support portions 56 are provided on the lower bearing members 60, 62, and 64, which prevents the rocker arms 22 and 24 from falling out of position when the head cover 34 is assembled onto the cylinder head 12. Also, gaps are provided between the lower bearing portions 66 of the lower bearing members 60, 62, and 64 and the intake camshaft 26 and the exhaust camshaft 30 so the lower bearing portions 66 do not directly support the intake camshaft 26 and the exhaust camshaft 30. As a result, the structure of the lower bearing members 60, 62, and 64 can be simplified and friction can be reduced.

Figure 9:
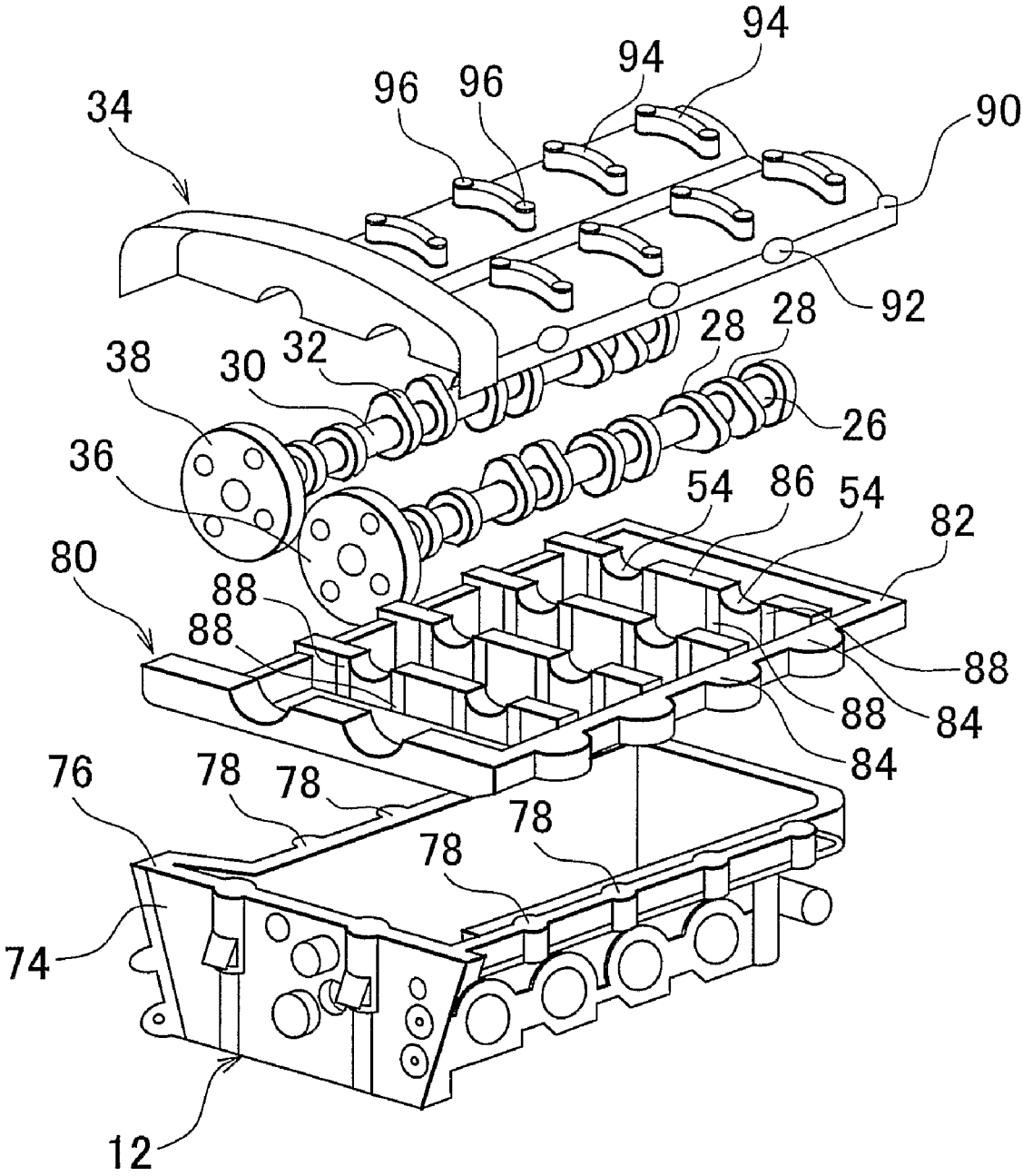
FIG. 9 is a sectional view of a camshaft support structure according to a fourth example embodiment.

Next, a fourth example embodiment of the invention will be described. FIG. 9 is a view showing a camshaft support structure according to the fourth example embodiment of the invention. More specifically, FIG. 9 is an exploded perspective view of the constituent elements included in the structure of this example embodiment. As shown in FIG. 9, the structure of this example embodiment includes the cylinder head 12 of the internal combustion engine.

The cylinder head 12 is made of aluminum or cast iron. Various elements, not shown, for forming four cylinders are formed within the cylinder head 12. Also, the cylinder head 12 includes a side wall 74 formed so as to surround these various elements. A circular peripheral edge portion 76 of the cylinder head 12 constitutes the uppermost portion of the side wall 74. A plurality of bolt fastening holes 78 are formed at predetermined intervals to the outside of the peripheral edge portion 76.

A ladder frame type lower cam carrier 80 (hereinafter simply referred to as "lower cam carrier 80") is assembled on top of the cylinder head 12. This lower cam carrier 80 has an outer frame portion 82 that is arranged so as to overlap with the peripheral edge portion 76 of the cylinder head 12. Bolt fastening holes 84 arranged so as to overlap with the bolt fastening holes 78 in the cylinder head 12 are provided to the outside of the outer frame portion 82.

Four bridge portions 86 are provided strung between opposing sides of the outer frame portion 82 inside the outer frame portion 82. The bridge portions 86 are positioned at the boundary portions of the four cylinders. Two lower bearing portions 54 are formed on each bridge portion 86. These lower bearing portions 54 are formed in semicircular concave shapes so that they can support the intake camshaft 26 and the exhaust camshaft 30 from below. Bolt fastening holes 88 are formed in the bridge portions 86 on both sides of each lower bearing portion 54.

The lower cam carrier 80 is structured such that the four bridge portions 86 and the outer frame portion 82 are integrated together. Also, the lower cam carrier 80 is made of magnesium or magnesium alloy. Although magnesium or magnesium alloy is less rigid than aluminum or cast iron of which the cylinder head 12 is made, it is lighter than aluminum and cast iron and has excellent sound insulating properties and heat insulating properties.

Accordingly, when the lower cam carrier 80 is made of magnesium or magnesium alloy, it has the following characteristics compared with when it is made of aluminum or cast iron. 1) It is difficult to ensure the rigidity of the lower cam carrier 80 independently. 2) The lower cam carrier 80 is lighter which results in a lighter internal combustion engine with a lower center of gravity. 3) Vibration damping is improved and the vibration deadening effect and sound radiation reduction effect are improved. 4) Heat transfer and heat radiation are suppressed and warm-up ability of the internal combustion engine is improved.

The intake camshaft 26 and the exhaust camshaft 30 are each assembled on the lower cam carrier 80 so as to be retained by the four lower bearing portions 54 which are parallel in the axial direction. In this example embodiment as well, two intake valves 18 and two exhaust valves 20 are provided for each cylinder. The intake camshaft 26 is provided with two intake cams 28 for each cylinder which correspond to the intake valves 18, and the exhaust camshaft 30 is provided with two exhaust cams 32 for each cylinder which correspond to the exhaust cams 20.

The head cover 34 is fixed on the lower cam carrier 80. The head cover 34 is provided with a flange portion 90 arranged so as to overlap with the outer frame portion 82 of the lower cam carrier 80 and covers the entire surface of the lower cam carrier 80 while supporting the intake camshaft 26 and the exhaust camshaft 30.

A plurality of bolt fastening holes 92 are provided in the flange portion 90 so as to overlap with the bolt fastening holes 84 in the lower cam carrier 80. The head cover 34 and the lower cam carrier 80 are fixed to the cylinder head 12 by fastening bolts, not shown, which pass through the bolt fastening holes 84 and 92 and screw into (i.e., are secured to) the bolt fastening holes 78.

The head cover 34 is provided with a plurality of bearing portions 94. Each bearing portion 94 is provided in a location corresponding to a lower bearing portion 54 and formed protruding on the outside of the head cover 54. The bearing portions 94 have upper bearing portions 42, not shown in FIG. 9, which form a pair with the lower bearing portions 54, just as in the first example embodiment, inside the head cover 34. The upper bearing portions 42, together with the lower bearing portion 54, retains the intake camshaft 26 and the exhaust camshaft 30 and are formed in semicircular concave shapes similar to the lower bearing portions 54.

Each bearing portion 94 has two bolt fastening holes 96 which overlap with the bolt fastening holes 88 in the lower cam carrier 80. The head cover 34 and the lower cam carrier 80 are fixed by fastening bolts, not shown, also at the portions with the bolt fastening holes 88 and the bolt fastening holes 96, i.e., also near the upper and lower bearing portions.

Figure 10:
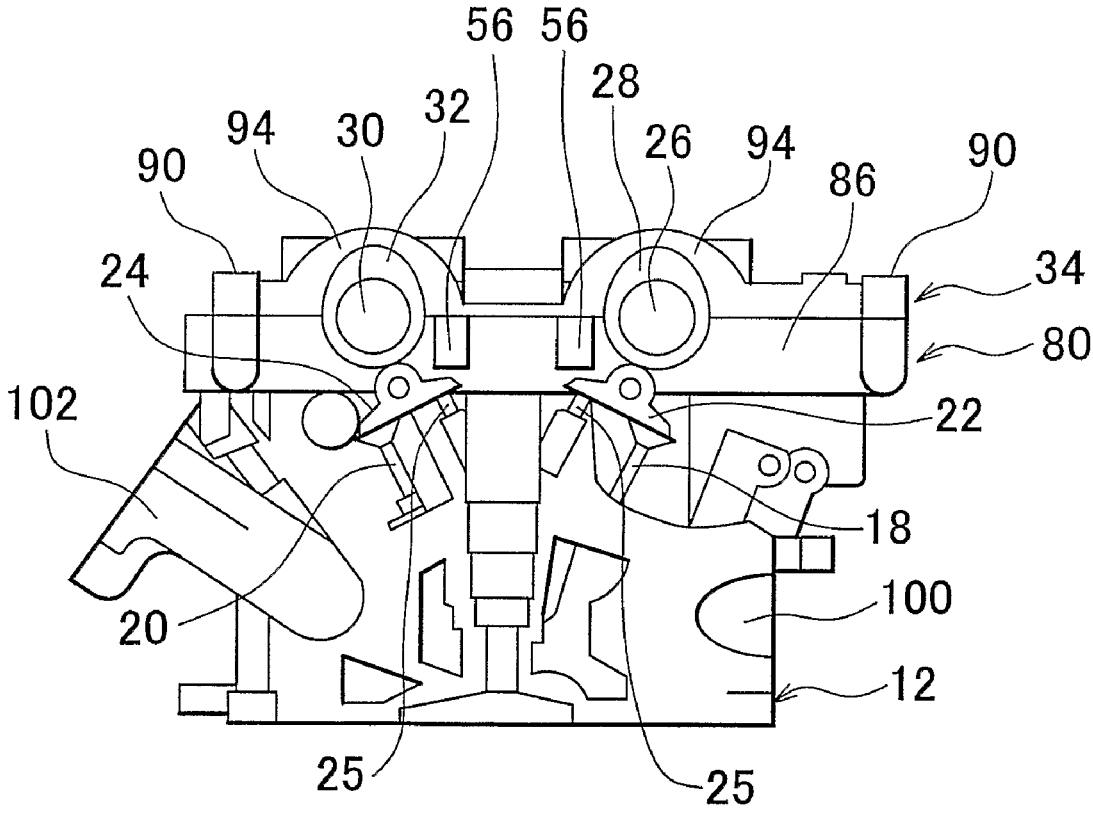
FIG. 10 is a sectional view of the camshaft support structure according to the fourth example embodiment shown cut along a plane that passes through the center of a cylinder.

FIG. 10 is a sectional view showing the camshaft support structure of this example embodiment cut along a plane that runs through the center a cylinder. As shown in FIG. 10, the inside of the head cover 34 is structured such that the bearing portions 94 on the intake side and the exhaust side are continuously and integrally formed with the left and right flange portions 90. The entire portion of the portions (including the bearing portions 94) extending between the left and right flange portions 90 faces and contacts the bridge portions 86 of the lower cam carrier 80.

The head cover 34 is made of magnesium or magnesium alloy, just like the lower cam carrier 80. Therefore, the head cover 34 has the following characteristics, similar to the lower cam carrier 80. 1) It is difficult to ensure the rigidity of the lower cam carrier 80 independently. 2) The lower cam carrier 80 is lighter which results in a lighter internal combustion engine with a lower center of gravity. 3) Vibration damping is improved and the vibration deadening effect and sound radiation reduction effect are improved. 4) Heat transfer and heat radiation are suppressed and warm-up ability of the internal combustion engine is improved.

Figure 11:
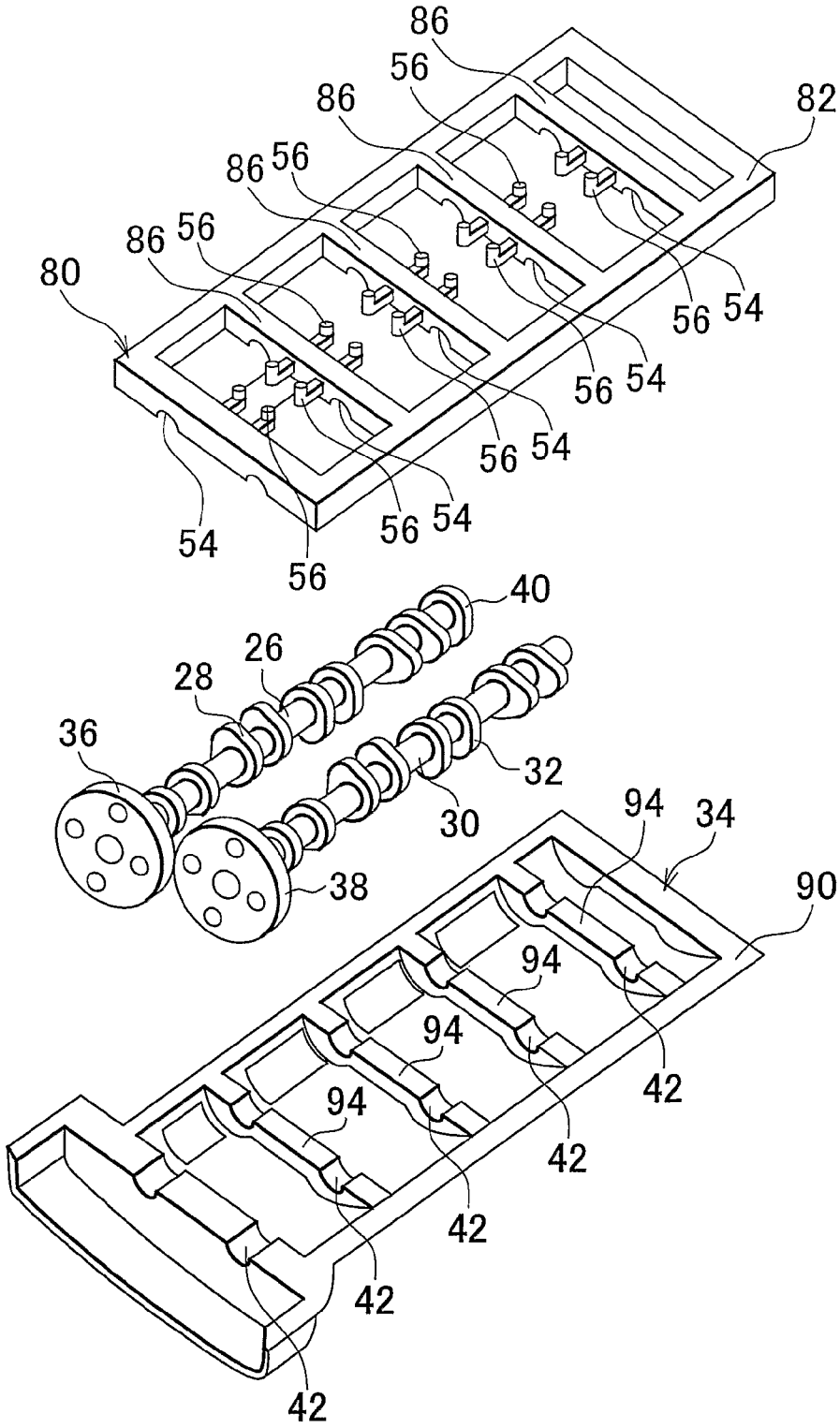
FIG. 11 is a perspective view showing in frame format the head cover as viewed from the rocker arm side.

FIG. 11 is a perspective view showing in frame format the head cover 34 as viewed from the side with the rocker arms 22 and 24. More specifically, FIG. 11 is an exploded perspective view showing the head cover 34, the intake camshaft 26, the exhaust camshaft 30, and the lower cam carrier 80. As shown in FIG. 11, the rocker arm support portions 56 are provided on both sides of four bridge portions 86. The rocker arm support portions 56 are provided integrally with the lower cam carrier 80 and the tips of the rocker arm support portions 56 protrude toward the cylinder head 12.

As shown in FIG. 10, when the head cover 34, the lower cam carrier 80, and the cylinder head 12 have been assembled, the rocker arm support portions 56 are positioned above the rocker arms 22 and 24.

In this example embodiment, after the intake camshaft 26, the exhaust camshaft 30, and the lower carrier 80 have been assembled and integrated with the head cover 34, the head cover 34 is then assembled onto the cylinder head 12. According to this kind of structure, when assembling the head cover 34 to which the intake camshaft 26, the exhaust camshaft 30, and the lower cam carrier 80 have been assembled, onto the cylinder head 12, the rocker arm support portions 56 come close to the upper portions of the rocker arms 22 and 24. As a result, even if the rocker arms 22 and 24 start to fall out of their predetermined positions during the assembly process, the upper surfaces of the rocker arms 22 and 24 abut against the rocker arm support portions 56, inhibiting them from doing so. As a result, the rocker arms 22 and 24 are prevented from falling out of position.

This obviates the need to reassemble the head cover 34 onto the cylinder head 12 which would otherwise be necessary if the rocker arms 22 and 24 fell out of position, and in turn greatly increases work efficiency during assembly.

Figure 12:
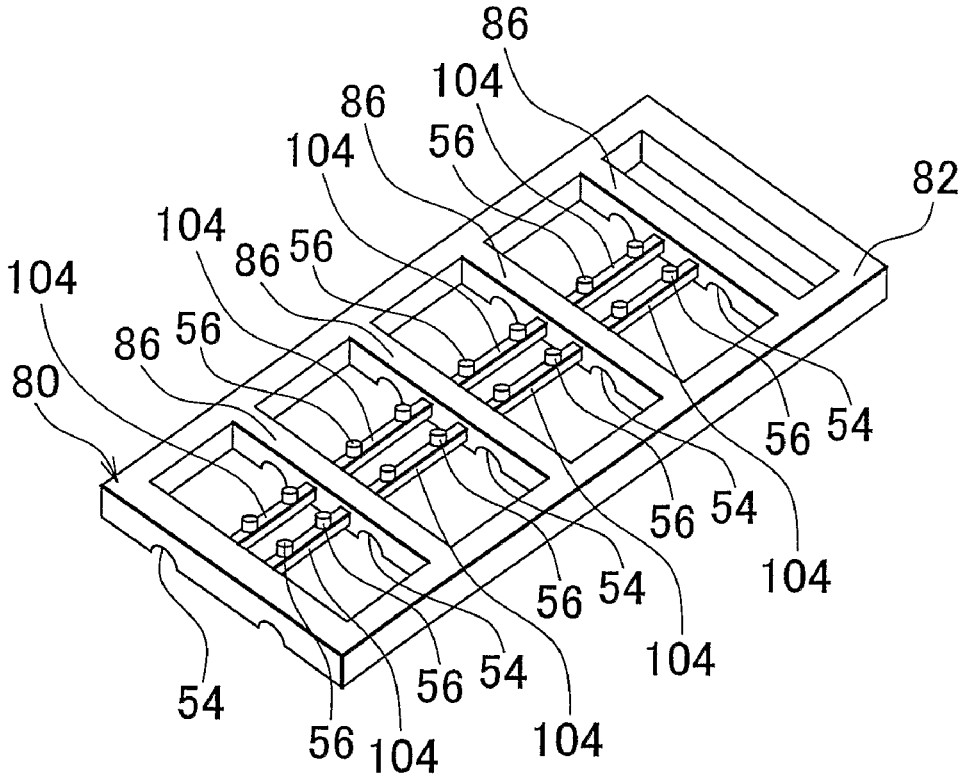
FIG. 12 is a frame format view of an example in which adjacent bridge portions are connected by two connecting portions and the rocker arm support portions are provided on the connecting portions.

FIG. 12 is a view of an example in which adjacent bridge portions 86 are connected by two connecting portions 104 and the rocker arm support portions 56 are provided on these connecting portions 104. According to this structure, providing the connecting portions 104 enables the rigidity of the lower cam carrier 80 to be further increased.

Also, in this example embodiment, the lower cam carrier 80 is fixed in a position sandwiched between the head cover 34 and the cylinder head 12, which has the following advantages.

As described in the third example embodiment, a large upward reaction force acts on the intake camshaft 26 at a position corresponding to each cylinder in sync with the valve opening timing of the intake valves 18 of each cylinder. For the same reason, a large upward reaction force also acts on the exhaust camshaft 30 at a position corresponding to each cylinder in sync with the valve opening timing of the exhaust valves 20 of each cylinder. Therefore, the support structure of the intake camshaft 26 and the exhaust camshaft 30 must be rigid enough to resist those reaction forces.

In this example embodiment, the bearing portions 94 having the upper bearing portions 42 are formed integrally with the head cover 34. According to this structure, the rigidity of the head cover 34 itself increases the rigidity of the bearing portions 94 so the rigidity of the upper bearing portions 42 is able to be greater than it is when the bearing portions 94 are provided separately.

Also, according to the structure of this example embodiment, the bridge portions 86 having the lower bearing portions 54 are formed integrally with the outer frame portion 82, which enables each bridge portion 86 to be supported by the outer frame portion 82. As a result, the rigidity of the lower bearing portions 54 is able to be greater than it is when the bridge portions 86 are provided separately.

As described above, the structure of this example embodiment is such that the upper bearing portions 42 and the lower bearing portions 54 independently are highly rigid. In addition, the structure of this example embodiment yields an exceptionally rigid support structure of the intake camshaft 26 and the exhaust camshaft 30 by combining the head cover 34 with the lower cam carrier 80 as follows.

That is, according to the structure of this example embodiment, the portions where the upper and lower bearing portions form pairs are connected to the cylinder head 12 via a double structured member in which the head cover 34 and the bridge portions 86 overlap at every location. That is, part of the head cover 34 is in constant close contact with the bridge portions 86 near the portions where the upper and lower bearing portions form pairs, and that close contact continues all the way to the left and right flange portions 90 or the outer frame portion 82. The double structured member described above is fastened on both sides of the bearing portions by bolts and thus functions as a strong single structured member when viewed from the outside.

According to this structure, force received by the intake camshaft 26 and the exhaust camshaft 30 is transmitted to the cylinder head 12 via the double structured member of the head cover 34 and the bridge portions 86 at every portion in the internal combustion engine. Therefore, according to the support structure of this example embodiment, the rigidity to support the camshaft is largely determined by the rigidity of the double structured member.

The double structured member of the overlapping head cover 34 and bridge portions 86 displays remarkable rigidity compared to the rigidity of either the head cover 34 or the bridge portions 86 by themselves. Therefore, the support structure of this example embodiment has extremely good characteristics in view of ensuring the rigidity to support the camshaft, with each of the upper bearing portions 42 and the lower bearing portions 54 individually displaying high rigidity.

As described above, in the support structure of this example embodiment, the head cover 34 and the lower cam carrier 80 are made of magnesium or magnesium alloy, both of which are less rigid than aluminum and cast iron. Despite this, the structure of this example embodiment is able to easily ensure rigidity for supporting the camshafts, as described above. Therefore, this structure is able to ensure sufficient rigidity to support the camshafts while having the head cover 34 and the lower cam carrier 80 formed out of magnesium or magnesium alloy.

As shown in FIG. 10, in the support structure according to this example embodiment, the boundary between the cylinder head 12 and the lower cam carrier 80 is set to be positioned directly above the intake port 100. This kind of structure makes it possible to keep the height of the cylinder head 12 as low as possible while still forming the intake port 100 in the cylinder head 12. That is, this structure enables the dimensions of lower cam carrier 80 and the head cover 34 to be as large as possible within the given dimensions of the internal combustion engine.

The lower cam carrier 80 and the head cover 34 are made of magnesium or magnesium alloy which is lightweight. On the other hand, the cylinder head 12 is made of aluminum or cast iron which is heavy compared with magnesium or magnesium alloy. Therefore, if the dimensions of the lower cam carrier 80 and the head cover 34 are made as large as possible and the height of the cylinder head 12 is made as low as possible, the internal combustion engine can be made as light as possible and its center of gravity can be lowered.

As described above, with the support structure of this example embodiment, the dimensions (thickness) of the lower cam carrier 80 and the head cover 34 are made as large as possible within the allowable limits. The outer frame portion 82 of the lower cam carrier 80 and the flange portion 90 of the head cover 34 display greater rigidity the thicker they are. Therefore, the outer frame portion 82 and the flange portion 90 can be made as rigid as possible within the given degree of freedom depending on the design features described above.

Making the outer frame portion 82 and the flange portion 90 highly rigid greatly contributes to both increasing the rigidity of the camshaft support structure and reducing the risk of an oil leak in the internal combustion engine. That is, when the support structure of this example embodiment is used, seal locations are created between the cylinder head 12 and the lower cam carrier 80, as well as between the lower cam carrier 80 and the head cover 34.

The head cover 34 and the lower cam carrier 80 are fixed to the peripheral edge portion 76 of the cylinder head 12 by fastening bolts. Oil leaks typically tend to occur at regions in between fastening bolts. Also, such oil leaks tend occur more easily the less rigid the members that are used in places where a seal is required.

With the structure according to this example embodiment, the peripheral edge portion 76 of the cylinder head 12, the outer frame portion 82 of the lower cam carrier 80, and the flange portion 90 of the head cover 34 are members that are used in places where a seal is required. The peripheral edge portion 76 is sufficiently rigid because it is made out of aluminum or cast iron, both of which are highly rigid than magnesium and magnesium alloy. The outer frame portion 82 and the flange portion 90 are made out of magnesium or magnesium alloy, but both display sufficient rigidity because they are sufficiently thick and essentially function as a strong single structured member (because they are fastened together near the bearing portions as well).

Therefore, according to the support structure of this example embodiment, the risk of an oil leak in the internal combustion engine can be sufficiently reduced despite the fact that seals are necessary in two locations and the lower cam carrier 80 and the head cover 34 are made of magnesium or magnesium alloy.

As described above, magnesium or magnesium alloy damps vibrations better than aluminum does. Therefore, making the lower cam carrier 80 and the head cover 34 out of magnesium or magnesium alloy improves the sound insulating properties and vibration deadening properties of the internal combustion engine. In addition, according to this example embodiment, the dimensions of the lower cam carrier 80 and the head cover 34 are made as large as possible, as described above. Accordingly, the structure of this example embodiment is able to receive the full benefits of the sound insulating properties and vibration deadening properties by using magnesium or magnesium alloy.

As described above, according to the fourth example embodiment, the rocker arm support portions 56 are provided on both sides of the bridge portions 86 of the lower cam carrier 80. Therefore, when the head cover 34, the intake camshaft 26, the exhaust camshaft 30, and the lower cam carrier 80 have been assembled into a single unit and that unit is then assembled to the cylinder head 12, the rocker arms 22 and 24 are inhibited from falling out of position. As a result, work efficiency during assembly can be improved.

While the invention has been described with reference to exemplary embodiments thereof, it is to be understood that the invention is not limited to the exemplary embodiments or constructions. To the contrary, the invention is intended to cover various modifications and equivalent arrangements. In addition, while the various elements of the exemplary embodiments are shown in various combinations and configurations, which are exemplary, other combinations and configurations, including more, less or only a single element, are also within the spirit and scope of the invention.

The invention claimed is:

1. A camshaft support structure of an internal combustion engine, comprising:

a camshaft that drives one of an intake valve and an exhaust valve;

a head cover that houses the camshaft;

first bearing portion which is provided on the head cover and supports the camshaft;

a second bearing portion which is attached to the head cover and makes a pair with the first bearing portion to support the camshaft;

a rocker arm that transmits driving force from the camshaft to one of the intake valve and the exhaust valve; and a rocker arm support member that inhibits the rocker arm from falling out of position by being provided near and directly above the rocker arm.

2. The camshaft support structure of an internal combustion engine according to claim 1, wherein the rocker arm support member is provided directly above the center of rotation of the rocker arm when the rocker arm is being driven.

3. The camshaft support structure of an internal combustion engine according to claim 1, wherein the rocker arm support member is positioned next to a side surface of the rocker arm.

4. The camshaft support structure of an internal combustion engine according to claims 1, wherein the rocker arm support member is provided on the head cover.

5. The camshaft support structure of an internal combustion engine according to claim 4, further comprising:

an oil injection hole which is provided in the rocker arm support member and through which oil is injected near the rocker arm.

6. The camshaft support structure of an internal combustion engine according to claim 1, wherein the rocker arm support member is provided on the second bearing portion.

7. The camshaft support structure of an internal combustion engine according to claim 6, wherein the second bearing portion and the camshaft are separated by a predetermined distance.

8. The camshaft support structure of an internal combustion engine according to claim 6, wherein there is a predetermined gap between the head cover and both ends of the second bearing portion when the second bearing portion has been fixed to the head cover.

9. The camshaft support structure of an internal combustion engine according to claim 1, wherein a plurality of the second bearing portions are provided, further comprising:

a connect member that connects the second bearing portions that are adjacent, wherein the rocker arm support member is provided on the connect member.

10. The camshaft support structure of an internal combustion engine according to claim 9, wherein a plurality of the second bearing portions are provided, further comprising:

an outer frame portion that connects the circumferences of the plurality of second bearing portions; and a cylinder head to which the intake valve, the exhaust valve, and the rocker arm are assembled, wherein the outer frame portion is sandwiched between the head cover and the cylinder head.

11. The camshaft support structure of an internal combustion engine according to claim 10, wherein the second bearing portion is integrally formed with the outer frame portion.

12. The camshaft support structure of an internal combustion engine according to claim 10, wherein at least one of the head cover and the outer frame portion is made of material that is lighter in weight than the material of which the cylinder head is made.

13. The camshaft support structure of an internal combustion engine according to claim 12, wherein the at least one of the head cover and the outer frame portion is made of one of magnesium and magnesium alloy.

14. The camshaft support structure of an internal combustion engine according to claim 1, wherein the second bearing portion is made of material that is lighter in weight than the material of which the head cover is made.

15. The camshaft support structure of an internal combustion engine according to claim 14, wherein the second bearing portion is made of at least one from among magnesium, magnesium alloy, and resin composite.

* * * * *